US006941595B1

(12) United States Patent
Michael

(10) Patent No.: US 6,941,595 B1
(45) Date of Patent: Sep. 13, 2005

(54) APPARATUS AND METHOD FOR A LIFT SEAT

(76) Inventor: M. Timothy Michael, P.O. Box 922, Fairhope, AL (US) 36533

( * ) Notice: Subject to any disclaimer, the term of this patent is extended or adjusted under 35 U.S.C. 154(b) by 0 days.

(21) Appl. No.: 10/748,917

(22) Filed: Dec. 22, 2003

(51) Int. Cl.[7] ..... A61G 7/10
(52) U.S. Cl. ..... 5/83.1; 297/344.12
(58) Field of Search ..... 5/81.1 R, 83.1, 5/86.1, 87.1; 297/344.12

(56) References Cited

U.S. PATENT DOCUMENTS 2,962,730 A * 12/1960 Carnes et al. ..... 5/86.1
3,596,298 A * 8/1971 Durst, Jr. ..... 5/87.1
3,829,916 A * 8/1974 James ..... 5/83.1
4,399,572 A 8/1983 Johansson
4,633,538 A * 1/1987 James ..... 5/83.1
4,920,590 A * 5/1990 Weiner ..... 5/86.1
5,421,639 A 6/1995 Bartholomew
6,161,232 A 12/2000 Von Schroeter et al.
6,185,761 B1 2/2001 Chapman et al.
6,389,619 B1 5/2002 Dunn
6,430,761 B1 8/2002 Brandorff et al.

* cited by examiner

*Primary Examiner*—Michael Trettel
(74) *Attorney, Agent, or Firm*—George L. Williamson

(57) ABSTRACT

The present invention discloses a portable lift seat to raise or lower a physically challenged user from a position on the floor to a standard height seated position or to a near standing position or vice versa. The lifting and lowering mechanism includes a seat with a rigid bottom supported by a seat support means which is attached to a lifting column standing upon a base fame. The lifting column is powered by an electric motor which may be controlled with a handheld control device. Alternatively, the lifting column may be powered by a manual crank. The base unit is equipped with wheels which engage for portability.

12 Claims, 1 Drawing Sheet

APPARATUS AND METHOD FOR A LIFT SEAT

BACKGROUND OF THE INVENTION

1. Field of the Invention

The present invention relates generally to lift seats and, more particularly, to an improved lift seat which assists a user in rising from and descending to a position on the floor.

2. Description of the Prior Art

Lift seats have been described in the prior art; however, none of the prior art devices disclose the unique features of the present invention.

In U.S. Pat. No. 6,430,761, dated Aug. 13, 2002, Brandorff, et al., disclosed an improved portable patient transfer device comprising a small wheeled base having a vertically disposed telescoping lifting column extending upwardly therefrom. A patient support means extends from the column to support the patient. A crank, accessible to both patient and attendant, is used to raise and lower the lifting column for transfer between surfaces with different heights, such as beds, wheelchairs, and car seats. The lift may be closed and temporarily attached to a wheelchair for convenient transport with a patient. The lift is small and lightweight and may be easily transported and stored. The lift is further economical to manufacture.

In U.S. Pat. No. 6,185,761, dated Feb. 13, 2001, Chapman, et al., disclosed a system for raising a person lying on the ground which includes a lifting seat comprising a back rest coupled to a seat portion. At either side of the back rest and seat portion t here are provided side supports. The system is such that in use it can be slid onto a person lying on his/her side, rotated such that the back rest lies on the ground, with the supports supporting the person during rotation to a back-lying position. The back rest can then be rotated upwardly to bring the person into a sitting position.

In U.S. Pat. No. 6,161,232, dated Dec. 19, 2000, Von Schroeter, et al., disclosed an invalid lifting device comprising a first mast upstanding from a first elongate chassis member and a second mast upstanding from a second elongate chassis member which is parallel or substantially parallel to the first chassis member. The lifting device also comprises a lifting arm supported by and extending between the first and second masts, the lifting arm comprising two parts pivotable relative to one another so that the distance between the masts can be varied. One part is supported by the first mast and the other part is supported by the second mast. Power operated means are provided for moving the two chassis members towards and away from one another. Each part of the lifting arm comprises a parallelogram linkage to maintain the chassis members in parallel or substantially parallel relationship as the two chassis members are moved towards and away from one another. Each mast may be telescopically extendible/retractable and power operated means may be provided for extending and retracting the two masts in synchronism with one another.

In U.S. Pat. No. 6,389,619, dated May 21, 2002, Dunn disclosed an invalid lifting device which includes a mobile chassis, a lifting mechanism and a sling connectible to the arm supports to assist in raising a seated person to a standing or substantially standing position. The lifting mechanism includes a lifting arm and an actuator device operative to raise and lower the lifting arm. The lifting arm is pivotable about first and second horizontal axis. The lifting mechanism also includes guiding elements defining a guide path along which the second horizontal axis is caused to move as the actuating device raises and lowers the lifting arm.

In U.S. Pat. No. 5,421,639 dated Jun. 6, 1995, Bartholomew disclosed a portable, storable lifting device for invalids. The device includes a jack base having a backwardly inclined jack upright on which is mounted a jack platen including a hook. Forward and rearward facing wheeled legs are provided attached to the jack base. Each forward facing leg is hinged to the jack base through a universal joint thereby allowing the legs to be folded into a compact position for transportation or storage. A segmented lever is provided. A folding seat is provided having a back hinged to a bottom. Strap means are attached to the seat bottom and to the seat back for securing to the seat both the upper and lower torso of a fallen invalid who is positioned prone on a floor surface. The seat includes dual function means attached to the back, both for using the segmented level to provide leverage to the seat, whereby the prone invalid is rotated to an upright sitting position, and for engaging the jack hook, whereby the seat containing the prone invalid is raised above the floor with the invalid in an upright sitting position.

In U.S. Pat. No. 4,399,572, dated Aug. 23, 1983, Johansson disclosed a seat comprising a carrier frame mounted on a hoisting gear and support means extending between outwardly directed carrier frame portions. Since the seats at patient-lifting devices often become very dirty, they need to be cleaned in special cleaning devices, so called decontamination devices. However, the present seats are not suitable for cleaning in cleaning devices of this type and time-consuming measurements are required to loosen and reengage the seats. In order to eliminate said problems and provide a seat that may be cleaned in especially efficient cleaning devices and further may be quickly and safely disconnected and connected in a simple manner the seat according to the invention is characterized by the features that the carrier frame comprises two separate sitting means spaced from each other to provide a seat with an opening therein, whereby each sitting means and/or the carrier frame has a coupling device adapted to permit fixing of the sitting means above the support means by moving the sitting means into engagement with the carrier frame and whereby each sitting means and/or carrier frame has a position indicator arranged such that any one from above may determine whether the sitting means is in fixed position above the support means.

While these lift seats may be suitable for the purposes for which they were designed, they would not be as suitable for the purposes of the present invention, as hereinafter described.

SUMMARY OF THE PRESENT INVENTION

The present invention discloses a lift seat which comprises a lifting column mounted upon a wheeled base frame capable of being rolled on an underlying surface. Attached to the lifting column is a seat support and a seat with a rigid bottom. The lifting column contains an acme screw mechanism powered by an electric motor equipped with a hand-held motor control device which comprises the means for moving the seat vertically up and down the lifting column from a lowest position wherein the seat is substantially resting on the underlying surface to a highest position which is substantially higher than a normal seating position. Alternately, the lifting means may comprise a manual crank. The present invention, therefore, provides a means by which a person could extract themselves from a position upon the floor and raise themselves to a normal seating height or to a near standing height. Alternately, the present invention provides a means whereby a person can lower themselves to the floor.

An object of the present invention is to provide a lifting seat which will raise the physically challenged occupant from the floor to a standard seating height or to a near standing height making standing easier for the occupant. Another object is to provide a liking seat which can be operated by a solo user and occupant or by a frail assistant. A further object is to provide a lifting seat which will allow the physically challenged user to easily self load into the lifting seat.

Another object is to provide a lifting seat which will also lower the user to the floor, to provide a lifting seat which can be used as a chair and to provide a lifting seat which is conducive to use in a residential environment. A further object is to provide a lifting seat which is economical to manufacture, provide a lifting seat which is compact, lightweight and portable, and provide a lifting seat which can be used in confined spaces. Further objects and advantages of this invention will become apparent from consideration of the drawings and ensuing descriptions.

The foregoing and other objects and advantages will appear from the description to follow. In the description reference is made to the accompanying drawings, which form a part hereof and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
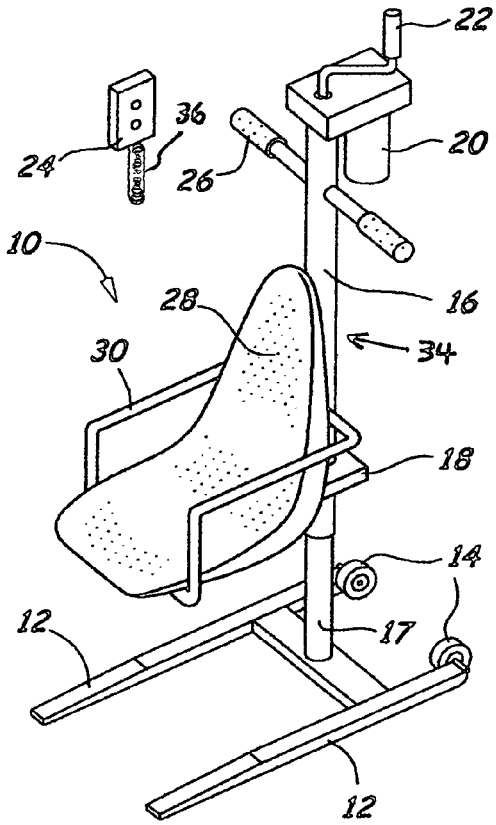
FIG. 1 is an isometric view of the present invention in its raised position.

With regard to reference numerals used, the following numbering is used throughout the drawings.

10 present invention
12 base
14 wheels
16 outer lifting column
17 internal lifting column
18 seat support
20 motor
22 crank
24 handheld control device
26 handle
28 seat
30 seat arms
32 non-skid pads
34 hoisting gear
36 cable

DETAILED DESCRIPTION OF THE PREFERRED EMBODIMENT

Turning now descriptively to the drawings, in which similar reference characters denote similar elements throughout the several views wherein the Figures illustrate the present invention wherein a lift seat is disclosed.

Figure 2:
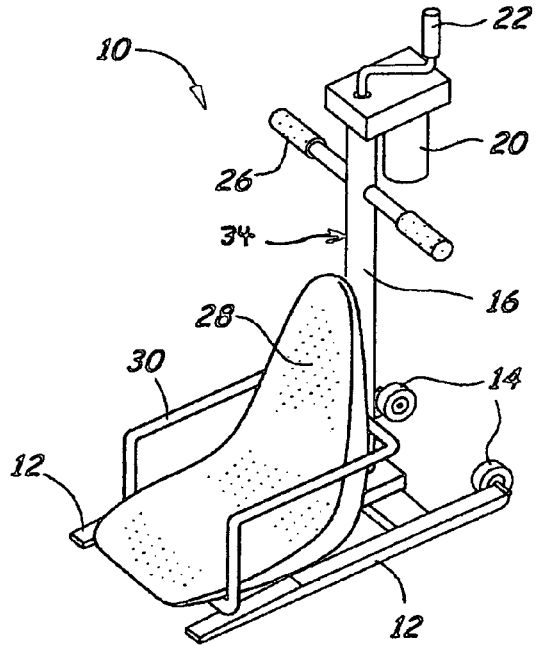
FIG. 2 is an isometric view of the present invention in its lowered position.
Figure 3:
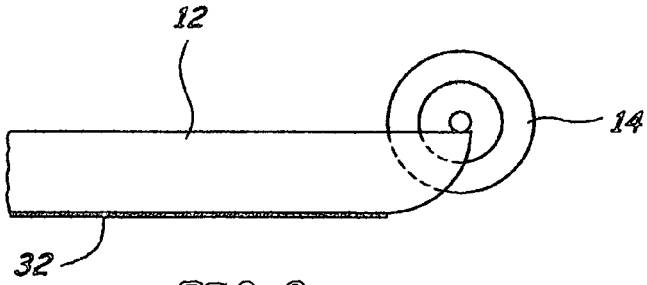
FIG. 3 is an elevation view of parts of the present invention.

Turning to FIG. 1, shown therein is an isometric view of the present invention 10. The base 12 is formed of steel tubing and has a front in the direction of the seat and a rear. At the rear are positioned a pair of wheels 14 slightly elevated so as not to be in contact with the floor except when the unit 10 is tilted backwardly as best shown in FIG. 3. The lifting column comprises an inner column 17 which is bolted or welded to base frame 12 and an outer column 16 to which the seat support frame 18 and handle 26 are attached. The outer column 16 is raised or lowered by an internal hoisting gear 34 which may be an acme screw or similar hoisting gear comprising a nut and bolt combination traversing the length of the column and which is turned by an electric motor 20 or manual crank 22. Hoisting gears 34 of this and similar types are previously known and therefore not further described. The electric motor is controlled by handheld control device 24 connected to the motor with a pig-tailed cable 36 or by a wireless device. The seat 28 is attached to the seat support 18 and has a rigid bottom with a sloped front lip which comes in direct contact with the floor when the seat is in its lowest position as best shown in FIG. 2. The seat 28 is equipped with arm supports 30.

Turning to FIG. 2, shown therein is the seat 28 in its lowest position in which the horizontal portion of the seat is nearly level with the floor or supporting surface.

Turning to FIG. 3, shown therein is the base 12 having wheels 14 affixed to the rear thereof. Non-skid pads 32 are disposed on the bottom side of the base 12.

By way of general explanation of the operation of the present invention, the lift seat is intended to be used either by a solo user or with the assistance of another person who is not required to possess any great amount of strength. It is designed to assist a user in rising from and being lowered to the floor. The user could be an elderly person who is otherwise quite mobile, but possibly stumbles and fills to the floor and although uninjured is unable to get off the floor. The user could also be a person who is desirous to position themselves on the floor for exercise purposes, but knows that they will be unable to regain a standing or upright sitting position without assistance.

The lift seat would generally be positioned at the height of a conventional chair when not being used for lifting and lowering which allows the lift seat to be used as a chair. When a physically challenged person stumbles and falls to the floor and there is another person present then that second person tilts the lift seat and rolls it to the fallen person. If the fallen person is alone they must manage to maneuver themselves to the lift seat. By using the hand held control device the seat is lowered to where the seat bottom is approximately touching the floor and the fallen person maneuvers themselves backwards into the seat. Then, using the hand held control device, the seat is raised to the desired height. The hand held control device can be operated by either the person in the lift seat or by an assisting person. Optionally, an assisting person can use the manual crank to raise and lower the seat.

If a person is desirous of positioning themselves on the floor, then a procedure reverse to the foregoing would be employed.

This portable lift seat provides the potential for a higher quality of independent living for a large and growing segment of our population, being those physically challenged due to advanced age, excessive weight or other applicable limiting condition. The nature of this invention allows it to be used in residential and commercial environments.

The foregoing detailed description of this invention should not be construed as limiting the scope of this invention, but merely describing some of the presently preferred embodiments. Many other variations, are possible. For example, the base legs could be foldable as well as the seat to allow for a more compact unit for storage and transportation. The seat arms could be removable to allow for easier side loading and unloading. The base could be equipped with wheels in such a manner as to negate the need to tilt the unit for relocation and the wheels could be equipped with locking devices which could be engaged prior to use. The drive motor could alternatively be battery powered which would allow for greater flexibility of use for this invention. The invention could rely totally upon the manual crank as the means for lifting which would lower the manufacturing cost and make the invention more affordable. The base could be broader and the wheels larger for easier exterior operation. The structural elements of the base, column, seat and seat support could vary in both material and shape. The lifting column described herein makes use of an acme screw. This operation could be achieved with other lifting means such as a bearing type linear actuator or pneumatic or hydraulic cylinder. The height of the lifting column could be increased and the seat allowed to tilt downward making loading and unloading from a standing position easier.

I claim:

1. A lift seat for moving a user to and from a floor, comprising:

a) a base frame, wherein said base frame is horizontally disposed to support the lift seat;

b) a lifting column disposed on said base frame, wherein said lifting column is upright standing;

c) a seat support disposed on said lifting column;

d) a seat disposed on said seat support for use by a person, wherein said seat has a substantially planar bottom, wherein said bottom is substantially rigid;

e) a hoisting gear disposed internal said lifting column for moving said seat up and down said lifting column; and, f) wherein said seat moves in a substantially vertical path from a lowest position wherein a front lip of the seat touches the floor to an uppermost position which is higher than a normal sitting height.

2. The lift seat of claim 1, wherein said hoisting gear further comprises an electric motor equipped with a handheld control device which controls the movement of said seat.

3. The lift seat of claim 2, wherein said handheld control device can be operated by the user of said seat.

4. The lift seat of claim 2, wherein said handheld control device can be operated by a person adjacent to said seat.

5. The lift seat of claim 4, further comprising a plurality of wheels being disposed on said base frame, wherein engagement of said wheels with the floor enables the lift seat to be rolled about for relocation.

6. The lift seat of claim 5, wherein said means for moving said seat comprises a handle disposed on said lifting column to assist in relocation of said lift seat.

7. The lift seat of claim 6, further comprising arms being disposed on said seat, wherein said arms are supported by said seat support, wherein said arms provide additional support for a person when entering and exiting said seat.

8. The lift seat of claim 7, wherein said base frame comprises a plurality of substantially horizontal legs connected by a cross member, said legs having a bottom side, wherein said bottom side of said legs are equipped with non-skid pads.

9. The lift chair of claim 8, wherein said wheels comprise a pair of wheels connected to said rear of said base frame in a slightly elevated position and on the opposite side of said lift column from said seat, wherein said wheels engage the floor when said lift chair is tilted in the direction of said wheels.

10. A method for raising and lowering a person to and from the floor, comprising:

a) providing a lift seat, the seat having a rigid bottom mounted on a seat support frame;

b) mounting the lift seat on a vertical lifting column supported by a base frame;

c) moving the lift seat up or down along the vertical lifting column; and, d) moving the front lip of the lift seat to a position which touches the floor when the lift seat is in the lowest position.

11. The method of claim 10, further comprising the step of controlling the movement of the lift seat with a handheld control device.

12. The method of claim 10, further comprising the step of using a manual hand crank to move the lift seat up and down the vertical lifting column.

* * * * *